US008333208B2

(12) United States Patent
Miller

(10) Patent No.: US 8,333,208 B2
(45) Date of Patent: Dec. 18, 2012

(54) COLLAPSIBLE WALKING DEVICE

(75) Inventor: F. Troy Miller, Logan, UT (US)

(73) Assignee: Stander Inc., Logan, UT (US)

( * ) Notice: Subject to any disclaimer, the term of this patent is extended or adjusted under 35 U.S.C. 154(b) by 38 days.

(21) Appl. No.: 12/936,715

(22) PCT Filed: Apr. 10, 2009

(86) PCT No.: PCT/US2009/040216

§ 371 (c)(1),
(2), (4) Date: Oct. 7, 2010

(87) PCT Pub. No.: WO2009/126892

PCT Pub. Date: Oct. 15, 2009

(65) Prior Publication Data

US 2011/0030749 A1 Feb. 10, 2011

Related U.S. Application Data

(60) Provisional application No. 61/051,223, filed on May 7, 2008, provisional application No. 61/043,953, filed on Apr. 10, 2008.

(51) Int. Cl.
*A61H 3/00* (2006.01)

(52) U.S. Cl. ..... 135/67; 135/74

(58) Field of Classification Search ..... 135/67, 135/74, 75, 141, 142, 114
See application file for complete search history.

(56) References Cited

U.S. PATENT DOCUMENTS

| | | | | |
|---|---|---|---|---|
| 1,303,416 | A * | 5/1919 | Tidyman | 182/155 |
| 2,734,554 | A * | 2/1956 | Ries | 482/66 |
| 2,960,148 | A | 11/1960 | Murcott | |
| 4,046,374 | A | 9/1977 | Breyley | |
| 4,481,965 | A | 11/1984 | Watkins | |
| 4,643,211 | A | 2/1987 | Morris et al. | |
| 4,729,395 | A | 3/1988 | Adamson | |
| 5,348,336 | A | 9/1994 | Fernie et al. | |
| 5,417,472 | A | 5/1995 | Elvinsson | |
| 5,499,856 | A | 3/1996 | Sorrell et al. | |
| 5,605,169 | A | 2/1997 | Light | |
| 5,687,984 | A | 11/1997 | Samuel | |
| 5,816,593 | A | 10/1998 | Che | |
| 6,032,914 | A * | 3/2000 | Bastida | 248/354.1 |
| 6,347,777 | B1 * | 2/2002 | Webber et al. | 248/354.1 |
| 6,386,575 | B1 * | 5/2002 | Turner | 280/647 |
| 7,306,246 | B2 * | 12/2007 | Gale | 280/87.05 |

(Continued)

FOREIGN PATENT DOCUMENTS

| | | |
|---|---|---|
| JP | 1047675 | 2/1989 |

(Continued)

OTHER PUBLICATIONS

International Preliminary Report for PCT/US2009/040216 dated Oct. 12, 2010.

*Primary Examiner* — Noah Chandler Hawk
(74) *Attorney, Agent, or Firm* — Stoel Rives LLP

(57) ABSTRACT

A collapsible walking device that can be disposed in an operative (open) configuration and a storage (closed) configuration. The open, operative configuration of the walking device provides a structure to aid a user in walking or standing. The closed, storage configuration allows for easy and convenient storage and transport of the walking device. The collapsible walking device can be transitioned from the operative configuration to the storage configuration in one motion. The walking device includes four support legs that extend to the ground from adjacent two handles.

12 Claims, 18 Drawing Sheets

U.S. PATENT DOCUMENTS

| | | | | |
|---|---|---|---|---|
| 2007/0012346 | A1* | 1/2007 | Choi | 135/114 |
| 2007/0163633 | A1* | 7/2007 | Gale | 135/67 |

FOREIGN PATENT DOCUMENTS

| | | |
|---|---|---|
| JP | 1262252 | 10/1989 |
| JP | 1262253 | 10/1989 |
| JP | 1297371 | 11/1989 |
| JP | 1297372 | 11/1989 |
| JP | 3186474 | 8/1991 |
| JP | 7024025 | 1/1995 |
| JP | 9202239 | 8/1997 |
| JP | 11217076 | 8/1999 |

* cited by examiner

COLLAPSIBLE WALKING DEVICE

TECHNICAL FIELD

The present disclosure relates generally to mobility assistance devices. More specifically, the present disclosure relates to walkers to assist individuals in standing or walking.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

It will be readily understood that the components of the embodiments as generally described and illustrated in the Figures herein could be arranged and designed in a wide variety of different configurations. Thus, the following more detailed description of various embodiments, as represented in the Figures, is not intended to limit the scope of the disclosure, but is merely representative of various embodiments.

While the various aspects of the embodiments are presented in drawings, the drawings are not necessarily drawn to scale unless specifically indicated.

FIGS. 1-5 show a collapsible walking device 110 in an operative configuration. FIGS. 6-10 show the collapsible walking device 110 in a storage configuration.

Figure 1:
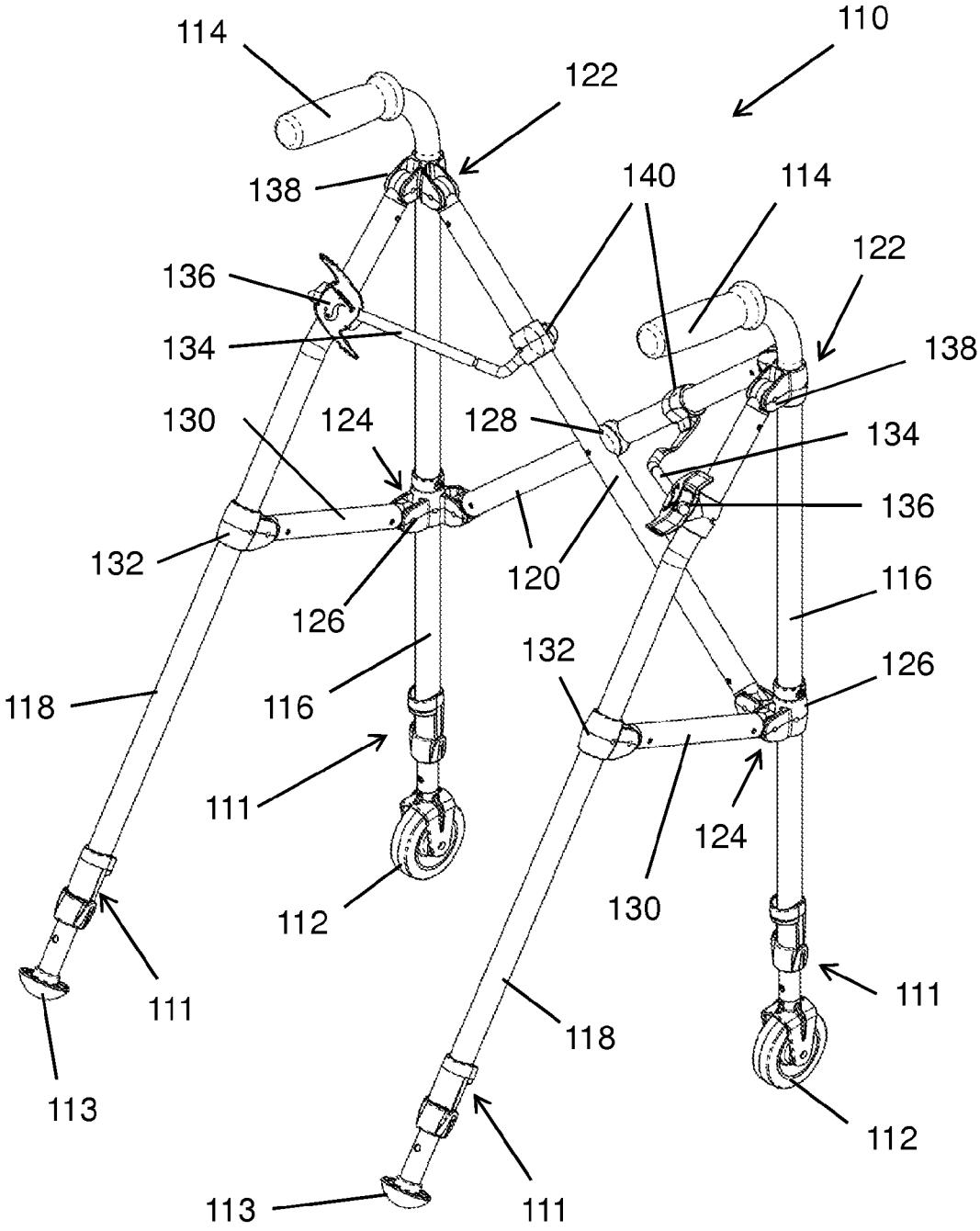
FIG. 1 is a perspective view of a collapsible walking device in an operative configuration, according to one embodiment.
Figure 2:
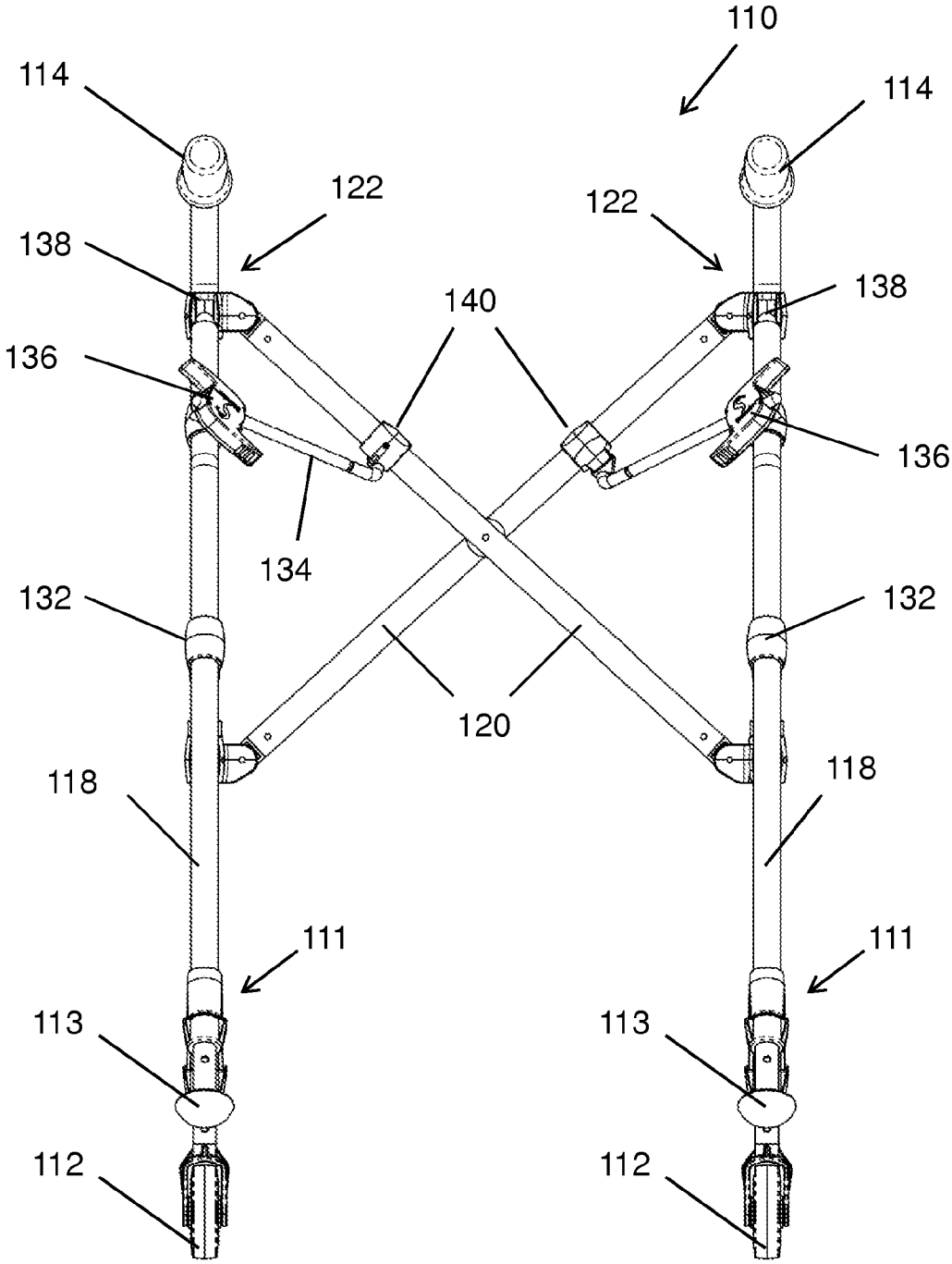
FIG. 2 is a rear side view of the collapsible walking device of FIG. 1 in an operative configuration.
Figure 3:
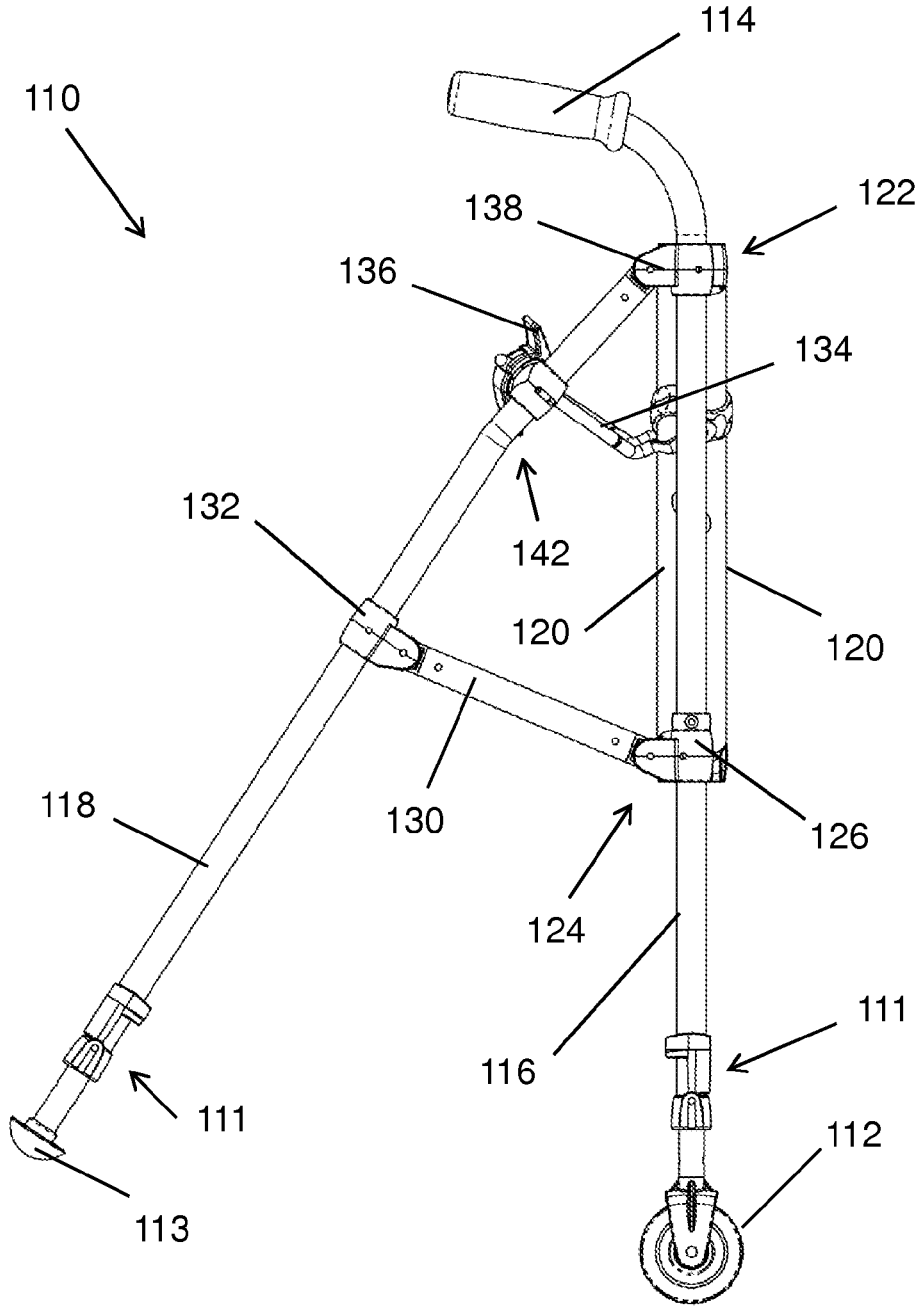
FIG. 3 is a lateral side view of the collapsible walking device of FIG. 1 in an operative configuration.
Figure 4:
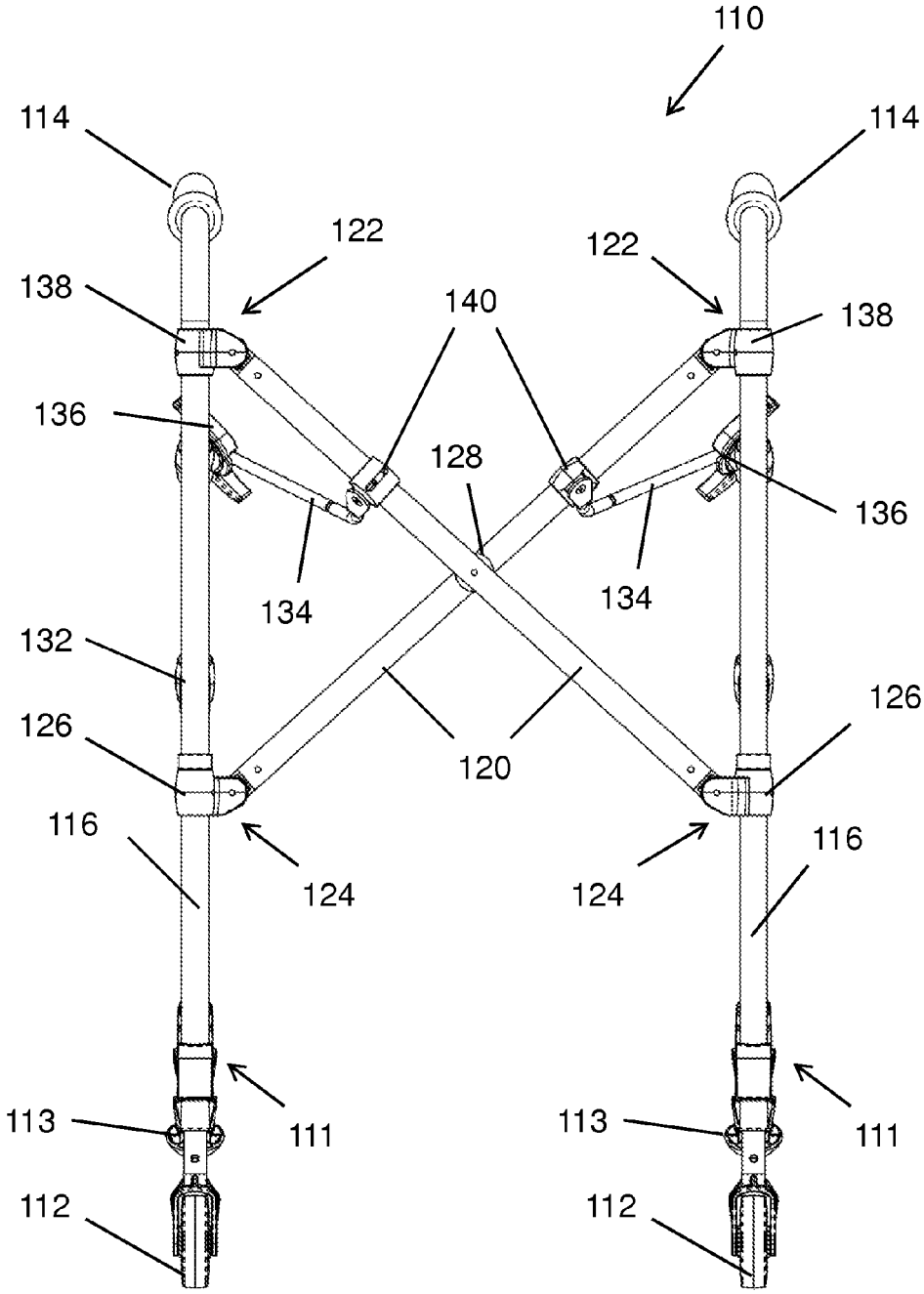
FIG. 4 is a front side view of the collapsible walking device of FIG. 1 in an operative configuration.
Figure 5:
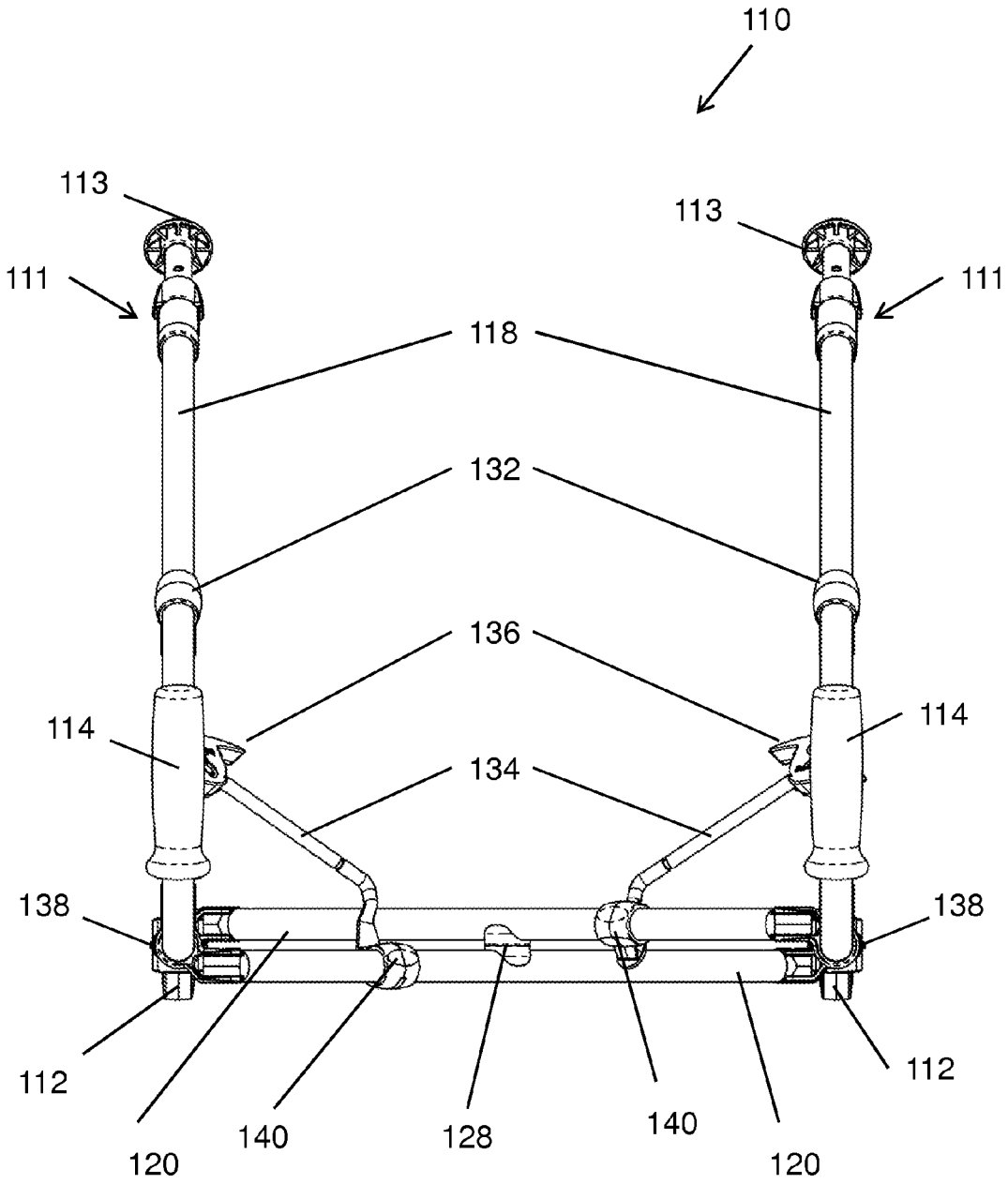
FIG. 5 is a top view of the collapsible walking device of FIG. 1 in an operative configuration.
Figure 6:
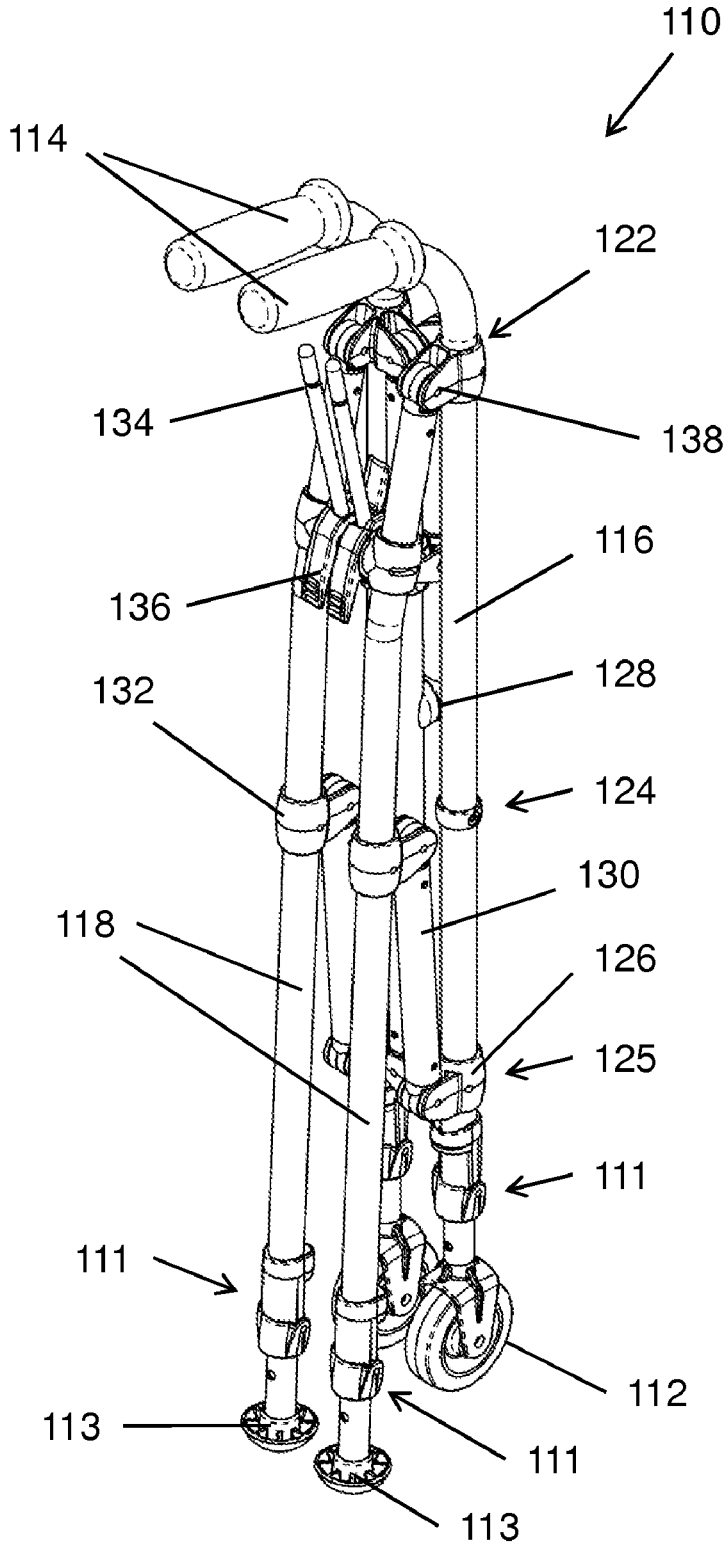
FIG. 6 is a perspective view of the collapsible walking device of FIG. 1 in a storage configuration.
Figure 7:
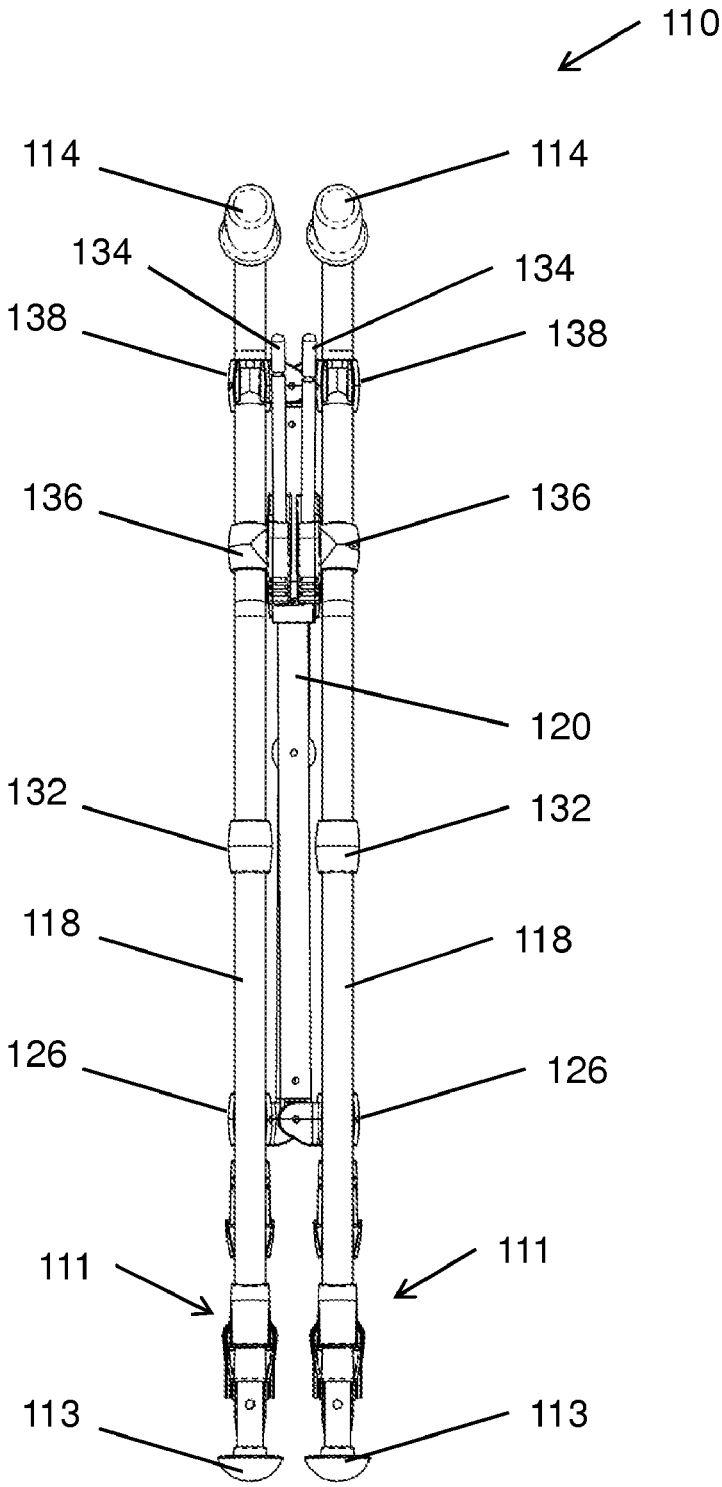
FIG. 7 is a rear side view of the collapsible walking device of FIG. 1 in a storage configuration.

Referring generally and collectively to FIGS. 1-10, the collapsible walking device 110 can be disposed in an operative (open) configuration and a storage (closed) configuration. The open, operative configuration of the walking device 110 provides a structure to aid a user in walking or standing, as best shown in FIG. 1. The closed, storage configuration allows for easy and convenient storage and transport of the walking device 110, as best shown in FIG. 6.

The walking device 110 includes four support legs that extend to the ground from adjacent the handles 114. Two forward-facing handle legs 116 are located in a forward position, which is in a location typically in front of the user in a direction that the user may wish to walk. The handle legs 116 can be coupled to, or integrated with the handles 114. The handles 114, which are configured to be grasped by a user, may extend at an angle from the handle legs 116 rearward toward the anticipated position of the user. The walking device 110 also includes rearward-facing support legs 118, which may be pivotably coupled to and extend at an angle from the handle legs 116 adjacent the position of the handles 114. The rearward-facing support legs 118 may extend from the handle legs 116 rearward towards the anticipated position of the user and downward toward the ground. The distal ends of the rearward-facing support legs 118 may contact the ground at a position nearly behind where a user of the walking device would be positioned, to thereby provide greater stability.

Figure 11:
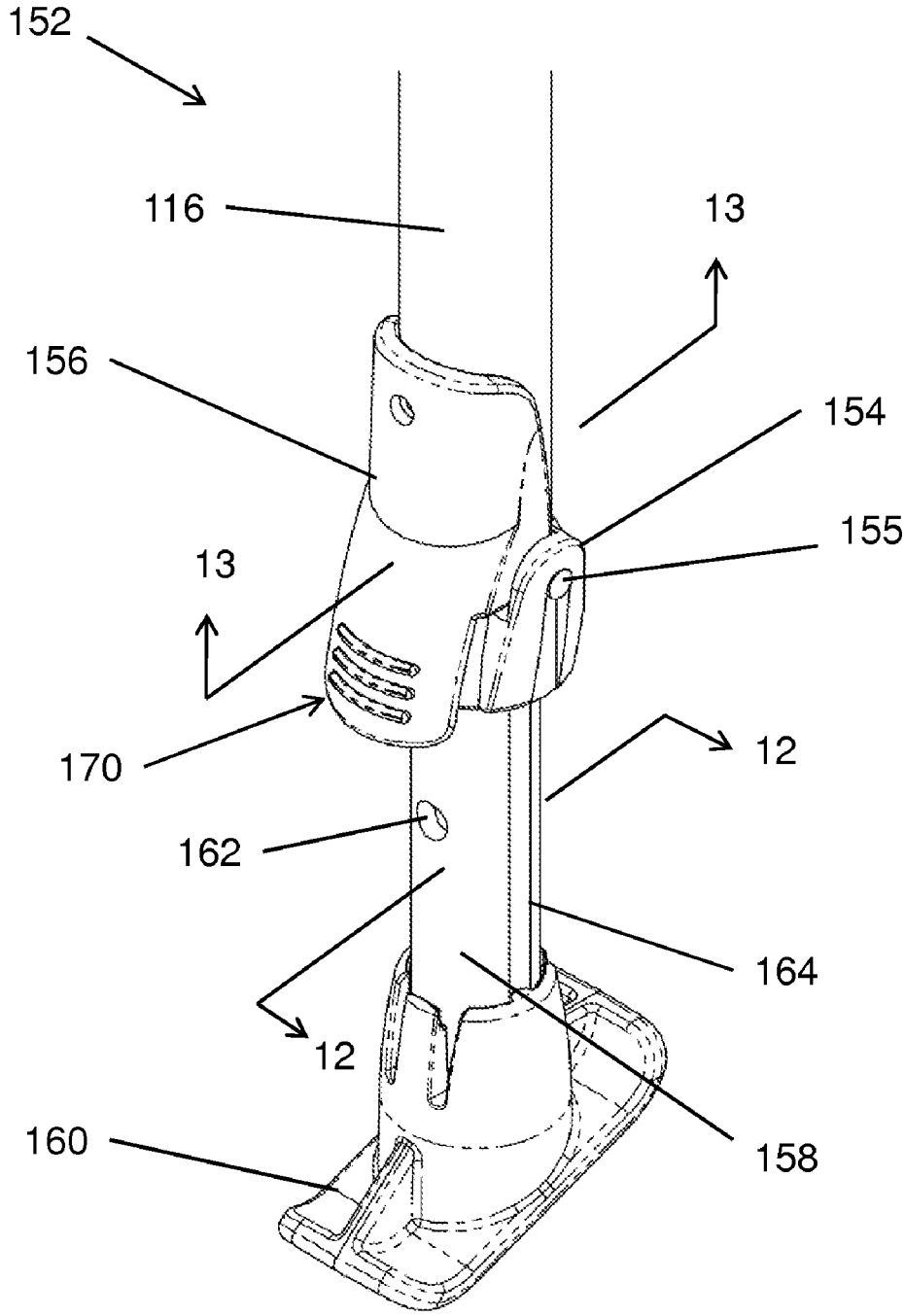
FIG. 11 is a close-up perspective view of a telescoping height adjustment mechanism of a collapsible walking device, according to one embodiment.
Figure 12:
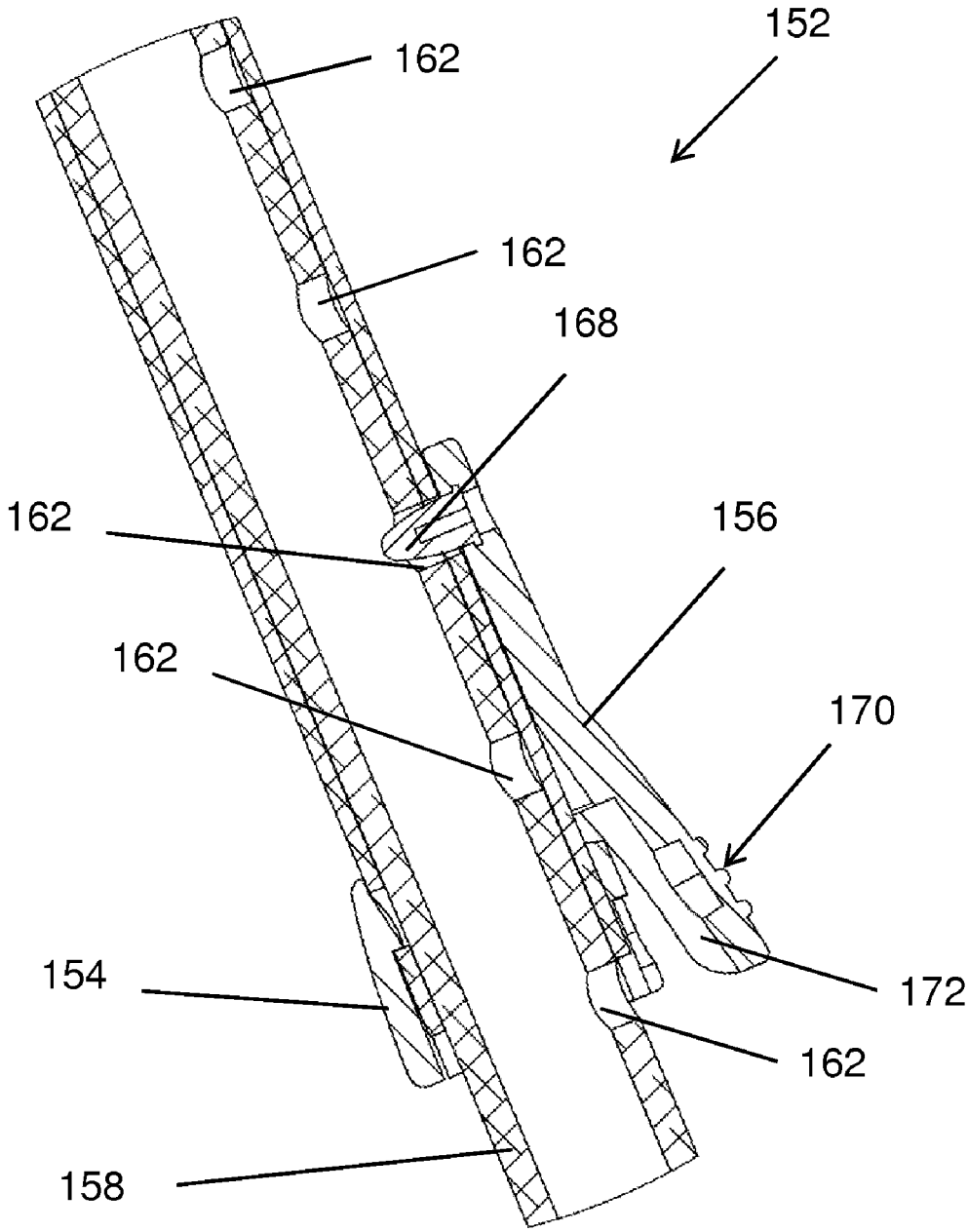
FIG. 12 is a longitudinal cross-section view of the telescoping height adjustment mechanism of FIG. 11.
Figure 13:
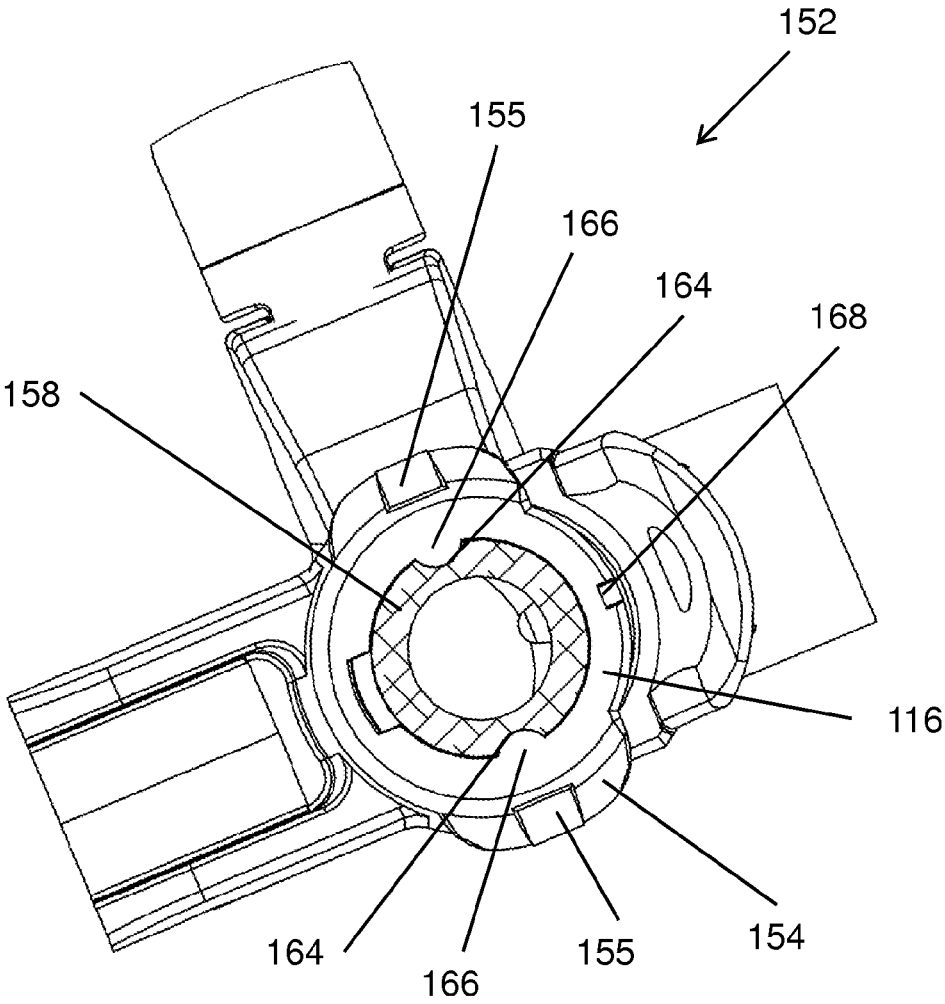
FIG. 13 is a lateral cross-section view of a telescoping height adjustment mechanism of FIG. 11.

The walking device 110 may optionally include wheels 112 or rollers coupled to the distal end of the handle legs 116 to aid in the mobility of the walking device 110. Additionally, brakes may optionally be included. Tips 113 may be coupled to the distal end of the rearward-facing support legs 118. As can be appreciated, wheels can also be coupled to the rearward-facing support legs 118 in place of the tips 113. Moreover, tips can be coupled to the handle legs 116 in place of the wheels 112. Each of the legs 116, 118 may include a height adjustment mechanism 111 to allow a user to increase the length of the legs 116, 118 and thereby adjust the height of the handles 114. A height adjustment mechanism, according to one embodiment, is shown in FIGS. 11-13, and discussed in greater detail below with reference to the same.

The walking device 110 may further include cross bars 120 that are each pivotably coupled to a first location 122 on a handle leg 116 at a position adjacent the handle 114, and also pivotably coupled to a second location 124 on the other handle leg 116 at a position spaced apart from the handle 114 and towards the ground. In one embodiment, the cross bars 120, while pivotably coupled to the handle leg 116 adjacent the handles 114, may be restricted from moving along the longitudinal length of the handle leg 116 at the first location 122. However, the cross bars 120 may also be slidably and pivotably coupled to the handle legs 116 at the second location 124, such that the joints 126 that pivotably couple the cross bars 120 to the handle legs 116 may move along the longitudinal length of the handle legs 116, towards the ground, as the walking device 110 is transitioned to the storage configuration. The cross bars 120 may also be pivotably coupled to each other at a center point 128 between the handle legs 116, i.e., where the cross bars 120 intersect.

In one embodiment, the walking device 110 also includes stabilizing bars 130, which extend between the handle legs 116 and the rearward-facing support legs 118. The joint 132 that couples a particular stabilizing bar 130 to its respective rearward-facing support leg 118 allows for pivoting movement of the stabilizing bar 130, but restricts longitudinal movement of the joint 132 along the longitudinal length of the rearward-facing support leg 118. The joint 126 that couples a particular stabilizing bar 130 to its respective handle leg 116 may allow for pivoting movement of the stabilizing bar 130 and longitudinal sliding movement of the joint 126 along the longitudinal length of the handle leg 116. In one embodiment, the joint 126 coupling the stabilizing bar 130 to the handle leg 116 is at the same longitudinal position along the handle leg 116 as the joint 126 at the second location 124 where the cross bar 120 is coupled to the handle leg 116. In another embodiment, there may be two separate joints at different longitudinal positions relative to each other along the handle leg 116.

The walking device 110 may also include triangulation support bars 134 that are each coupled to a cross bar 120 and a rearward-facing support leg 118. The triangulation support bars 134 provide stability to the walking device 110, and may optionally lock the walking device 110 in the operative configuration. In one embodiment, each triangulation support bar 134 is rotatably coupled to its respective cross bar 120, but may be fixed and not slidably coupled to the cross bar 120. A joint 140 couples the triangulation support bar 134 to the cross bar 120. The joint 140 may allow pivoting in two axes of rotation. The joint 140 may comprise a sleeve configured to rotate about the longitudinal axis of the cross member 120 and may also allow the triangulation support bar 134 to pivot relative to the sleeve. Furthermore, according to one exemplary embodiment, each triangulation support bar 134 is coupled to its respective rearward-facing support leg 118 through a locking joint 136 that permits linear movement of the triangulation support bar 134 through the locking joint 136. The triangulation support bar 134 moves linearly through the locking joint 136 as the walking device 110 is transitioned between the operative configuration and the storage configuration. Each locking joint 136 is rotatably coupled to a rearward-facing support leg 118.

When a user desires to place the walking device 110 into the compact, storage configuration, the locking joints 136 are disengaged and the handles 114 are moved toward each other, while simultaneously the rearward-facing support legs 118 move toward the handle legs 116. The arrangement of the various joints may help to collapse the walking device 110 into the storage configuration. The joints 138 adjacent the handle 114 (at the first location 122), pivotably coupling the cross bar 120 to the handle leg 116 and the rearward-facing support leg 118 to the handle leg 116, remain stationary. Stated differently, the joints 138 do not slide along the longitudinal length of the handle legs 116. The pivoting joint 132 coupling the stabilizing bar 130 to the rearward-facing support leg 118 also remains stationary along the longitudinal length of the rearward-facing support leg 118. The joint 140 coupling the triangulation bar 134 to the cross bar 120 and the joint 136 coupling the triangulation bar to the rearward-facing support leg 118 also may remain stationary and not permit slidable movement along the longitudinal length of the cross bar 120 or rearward-facing support leg 118.

Figure 8:
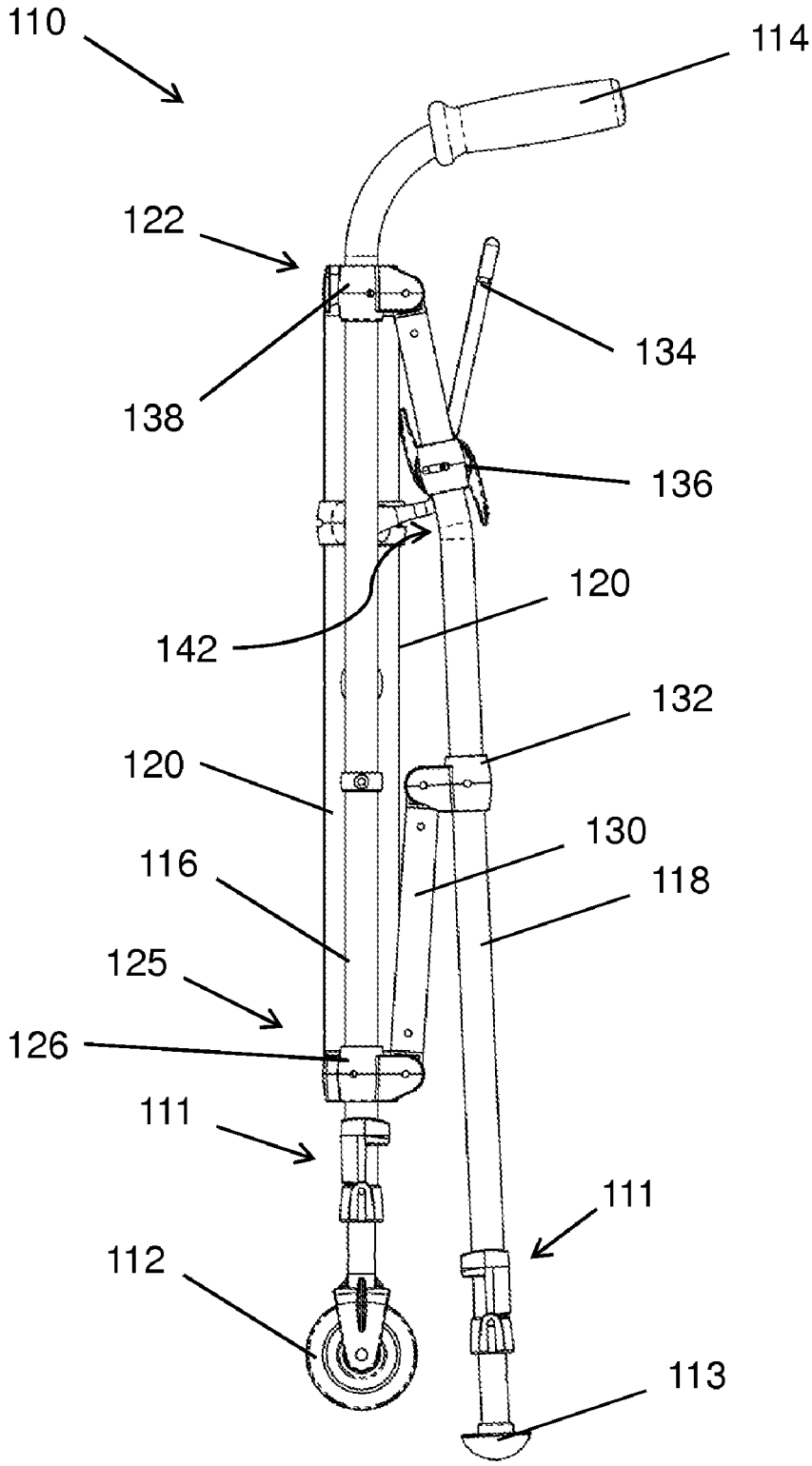
FIG. 8 is a lateral side view of the collapsible walking device of FIG. 1 in a storage configuration.
Figure 9:
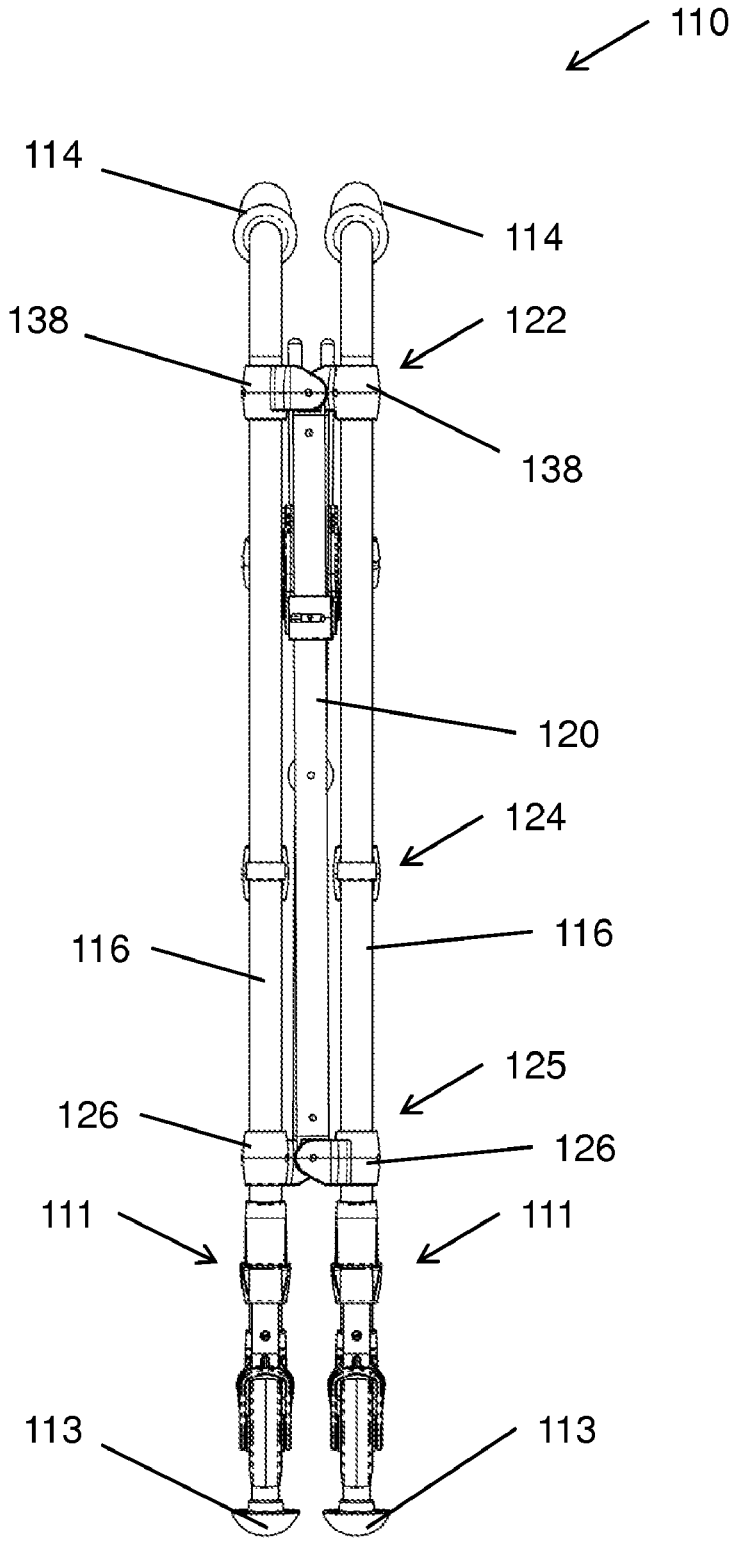
FIG. 9 is a front side view of the collapsible walking device of FIG. 1 in a storage configuration.
Figure 10:
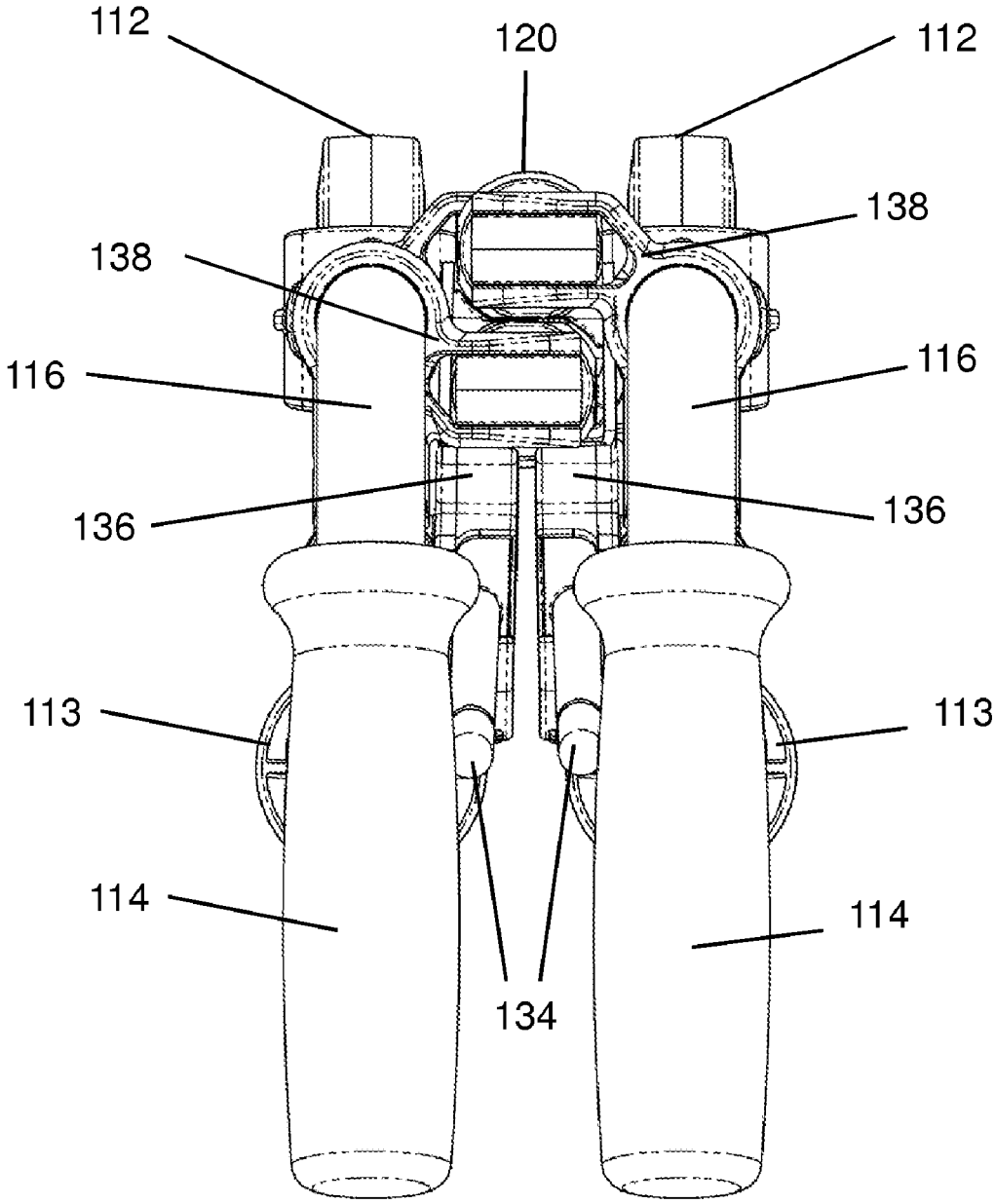
FIG. 10 is a top view of the collapsible walking device of FIG. 1 in a storage configuration.

However, the pivoting joints 126 coupling the cross bar 120 to the handle leg 116 (at the second location 124) and the stabilizing bar 130 to the handle leg 116 are capable of sliding along the longitudinal length of the handle leg 116. When the user moves the handles 114 toward each other, and thereby moves the handle legs 116 toward each other, the stabilizing bars 130 and the triangulation bars 134 move to a more vertical orientation in the storage configuration, instead of a more horizontal orientation of the operative configuration. The cross bars 120 also move to a more vertical orientation, causing the pivoting joints 126 to slide downward along the longitudinal length of the handle leg 116 to a third location 125. The rearward-facing support legs 118 are in turn pulled toward the handle legs 116. The arrangement of the handle legs 116 and the rearward-facing support legs 118 when all pulled together allows for the compactability of the walking device 110 in the storage configuration, as best shown in FIGS. 6-10. As shown in FIG. 8, in one embodiment, the rearward-facing support legs 118 may include a slight bend 142 to permit the placement of the stabilizing bar 130 between the handle leg 116 and the rearward-facing support leg 118 in the storage configuration.

FIGS. 11-13 are one embodiment of a telescoping height adjustment mechanism 152, which may optionally be used at the ends of the handle legs and/or the rearward-facing support legs. FIG. 11 is a close-up perspective view of the telescoping height adjustment mechanism 152. FIG. 12 is a longitudinal cross-sectional view of the telescoping height adjustment mechanism 152 along the plane 12-12 indicated in FIG. 11. FIG. 13 is a lateral cross-sectional view of the telescoping height adjustment mechanism 152 along the plane 13-13 indicated in FIG. 11. A handle leg 116 is shown in FIGS. 11-13, but it can be appreciated that the telescoping height adjustment mechanism 152 can also be used as described herein with a different leg, such as a rearward-facing support leg 118 shown in FIGS. 1-10. The telescoping adjustment mechanism 152 may comprise a stationary pivot component 154, a telescoping tube 158, and a button pivoting component 156. The button pivoting component 156 may be configured to couple to and pivot relative to the stationary pivot component 154, and thereby engage and secure the telescoping tube 158 at a relative position within the handle leg 116. The stationary pivot component 154 and button pivoting component 156 can be formed of a rigid material such as plastic or metal.

Figure 15:
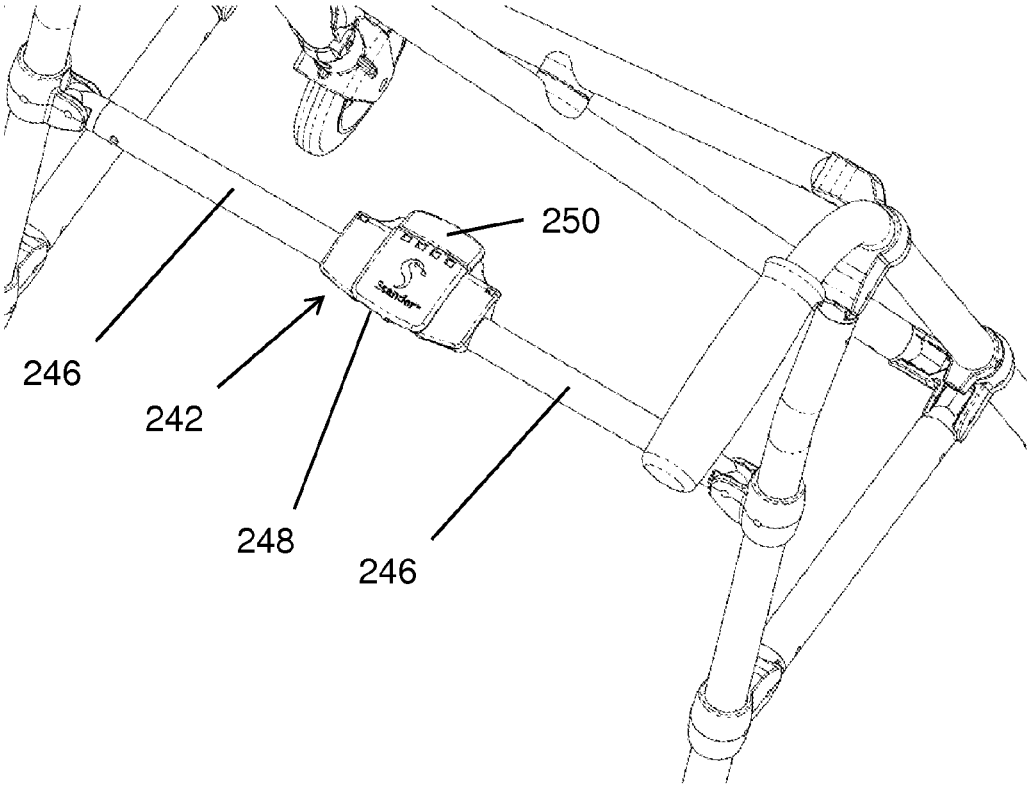
FIG. 15 is a close-up perspective view of the latch mechanism of the collapsible walking device of FIG. 14 in an operative configuration.

The stationary pivot component 154 may be configured to be secured to a leg of a walking device, such as a handle leg 116 of the walking device 110 of FIGS. 1-10. The stationary pivot component 154 is secured at a distal end of the handle leg 116, proximate to the ground. As shown in FIG. 15, the stationary pivot component 154 may comprise a collar adapted to be secured around the distal end of the leg 116 with a rivet or other securement device. In another embodiment, the stationary pivot component 154 can be adapted be secured to the leg 116 at the end of the leg, such as with a glue or adhesive, threads, or other securement mechanism. The stationary pivot component 154 provides a pivot point 155 about which the button pivoting component 156 can rotate. The pivot point 155 may comprise an axle and/or an axle seat. The stationary pivot component 154 may comprise one of the axle or axle seat and the button pivoting component may comprise the other. The stationary pivot component 154 can also be adapted to restrict rotational movement of the telescoping tube about a longitudinal axis, as will be described more fully below.

The telescoping tube 158 may be at least partially received within and slidably moveable relative to a shaft comprising the handle leg 116. A proximal end of the telescoping tube 158 is inserted into the handle leg 116 and is slidably movable along a longitudinal axis of the handle leg 116. As the telescoping tube 158 is moved in a direction toward the handle leg 116, i.e., inserted further within the handle leg 116, the length is shortened, thereby reducing the height of the handle leg 116. As the telescoping tube 158 is extended away from the handle leg 116, i.e. partially withdrawn from the handle leg 116, the height of the handle leg 116 increases. A distal end of the telescoping tube may be coupled to a tip 160. The tip 160 may be a foot-style tip, as shown in FIG. 11. In another other embodiment, the tip 160 may comprise a shock absorbing tip, a wheel-tip, or any suitable tip.

The telescoping tube further comprises a plurality of aligned holes 162 that are spaced along a length of a portion of the telescoping tube 158. As best shown in FIG. 12, the holes 162 can be engaged by a pin 168 of the button pivoting component 156 to secure the telescoping tube 158 at a relative position within the leg 116. The telescoping tube 158 can further comprise one or more groves 164 that extend longitudinally along the telescoping tube 158. As best shown by FIG. 13, the stationary pivot component 154 may comprise one or more complementary protrusions 166 to engage the one or more groves 164. The groves 164 and complementing protrusions enable the telescoping tube 158 to be slidably movable with respect to the leg 116 while also restricting rotation of the telescoping tube 158 relative to the leg 116 about a longitudinal axis of the telescoping tube 158. In another embodiment, the telescoping tube 158 may comprise protrusions (rather than grooves) and the stationary pivot component 154 may comprise complementary grooves. In still another embodiment, the leg 116 may comprise complementary protrusions and/or grooves to engage the telescoping tube 158.

Figure 16:
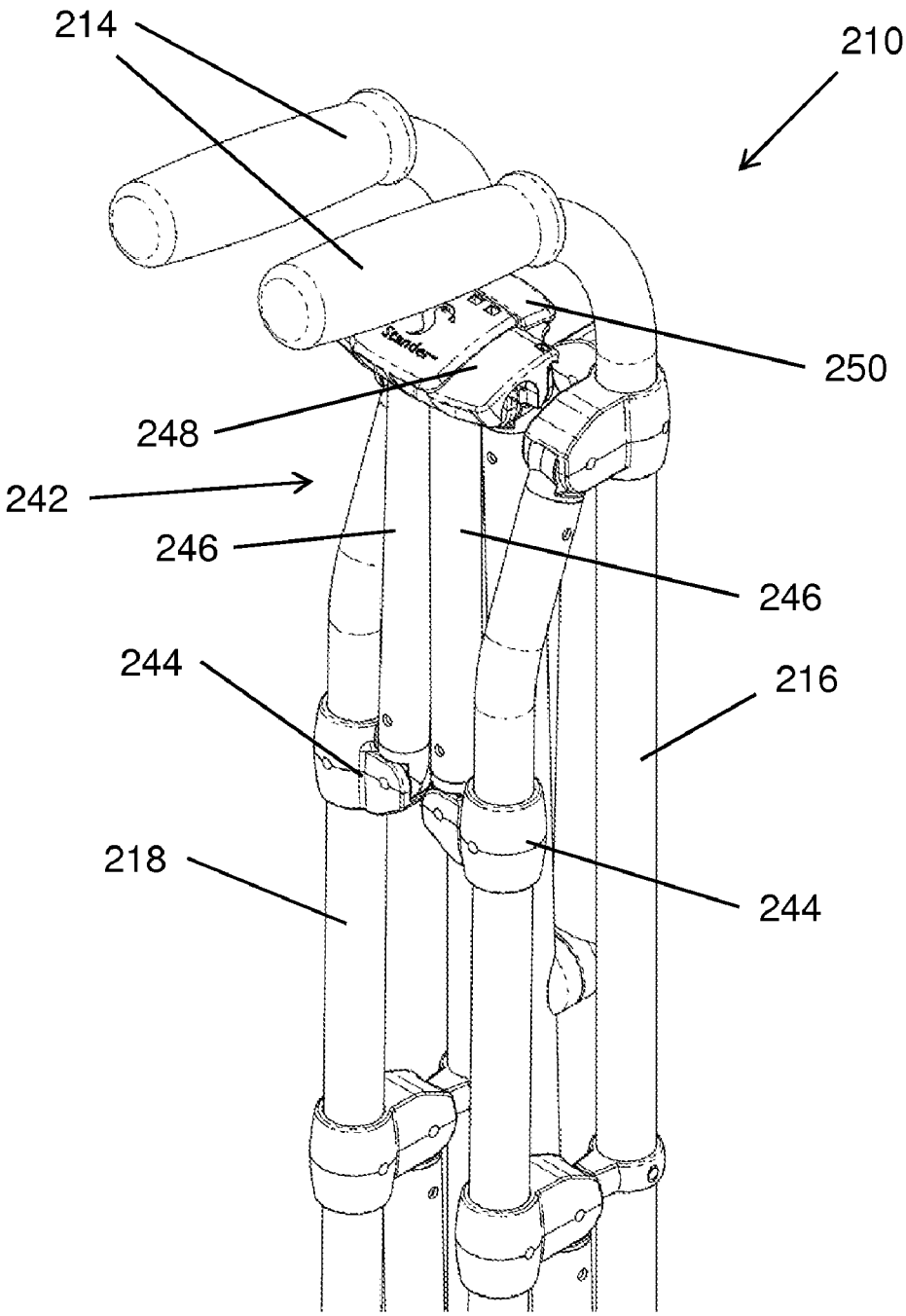
FIG. 16 is a close-up perspective view of the collapsible walking device of FIG. 14 in a storage configuration.

The button pivoting component 156 is adapted to releasably secure the telescoping tube 158 relative to the leg 116. With reference to FIGS. 15 and 16, the button pivoting component 156 may comprise a pin 168, a button portion 170 and a biasing member 172. The pin 168 may be disposed at a first end and configured to engage, one at a time, the aligned holes 162 in the telescoping tube. In this manner, slidable movement of the telescoping tube 158 is restricted and the telescoping tube 158 is secured relative to the leg 116. The button portion 170 is disposed on a second end of the button pivoting component 156, on an opposite side of a pivot point 155 about which the button pivoting component 156 rotates. The button pivoting component 156, including the pin 168 and button portion 170, rotate about the pivot point 155. As previously noted, the pivot point 155 can comprise an axle and/or an axle seat. The button pivoting component may comprise one of the axle and/or the axle seat. Depressing the button portion 170 causes the button pivoting component 156 to rotate about the pivot point 155, and causes the pin 168 to also rotate about the pivot point 155.

A user can depress the button portion 170 to disengage the pin 168, allowing the telescoping tube 158 to slidably move with respect to the leg 116. With the pin 168 disengaged, the user can increase, or decrease, the height of the leg 116 by further extending, or inserting, the telescoping tube 158 relative to the leg 116, respectively. The biasing member 172 biases the button portion 170 of button pivoting component 156 toward an undepressed position and, correspondingly, the pin 168 toward engagement of the aligned holes. Stated differently, the biasing member 172 biases the button pivoting component 156 toward securement of the telescoping tube 158 relative to the leg 116.

In the illustrated embodiment, the button portion 170 of the button pivoting component 156 is positioned below, or distal to, the pin 168. Accordingly, the pin extends through an opening in the leg 116 to engage the holes 162 in the telescoping tube. As can be appreciated, in another embodiment, the button portion 170 of the button pivoting component 156 may be positioned distal to the button portion 170. Accordingly the pin 168 can engage the holes 162 in the telescoping tube 158 without extending through an opening in the leg 116.

Figure 14:
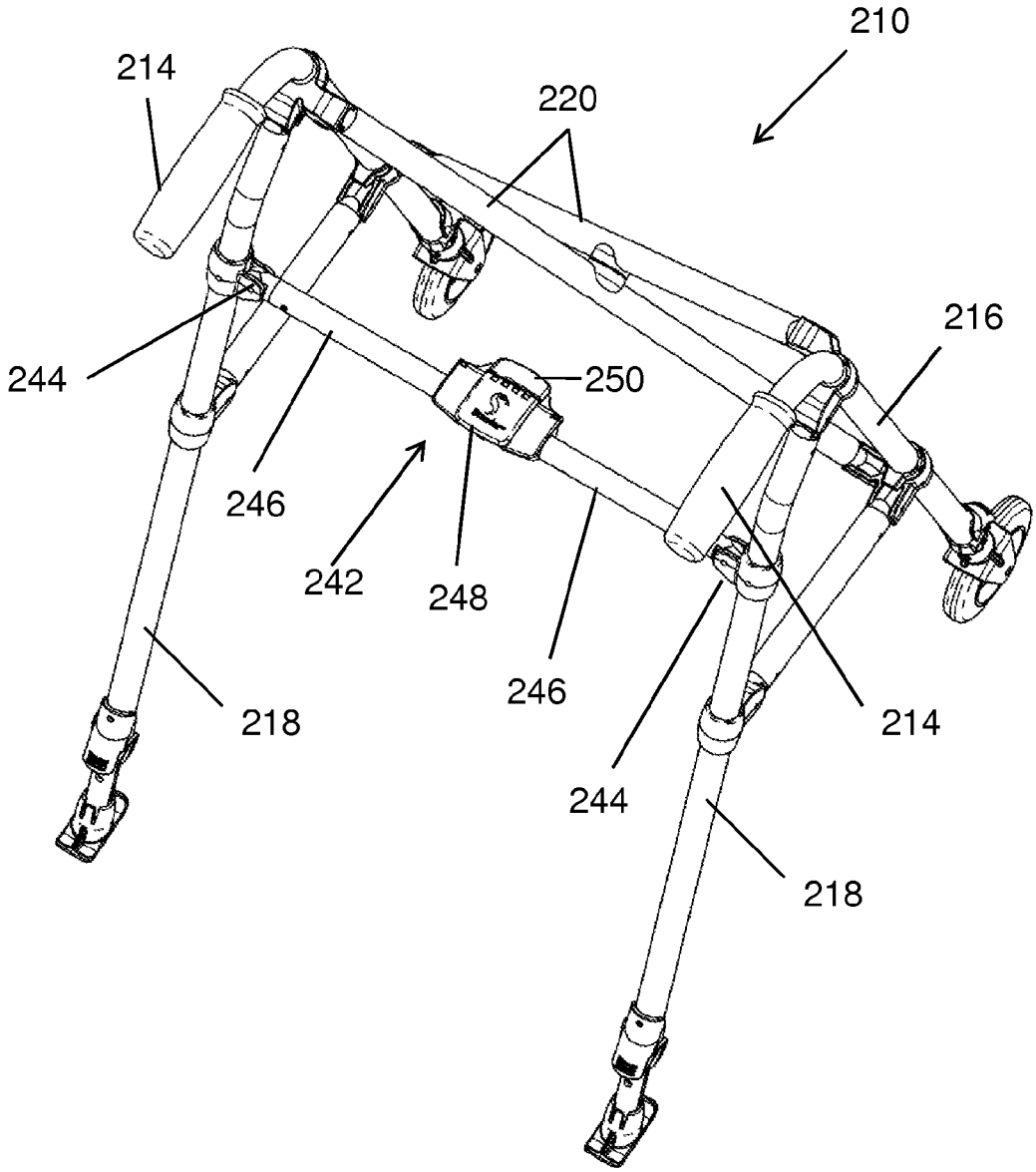
FIG. 14 is a perspective view of a collapsible walking device in an operative configuration, according to another embodiment.

FIGS. 14-16 illustrate another embodiment of a compressible walking device 210. The walking device 210 is similar to the walking device 110 of FIGS. 1-10 in structure and operation, having a operable configuration and a storage configuration. The structure of the walking device 210 includes many similar components, including handles 214, handle legs 216, rearward-facing support legs 218, and cross bars 220. However, the triangulation support bars and locking joints are replaced by a pivot support 242 that extends between the rearward-facing support legs 218. The pivot support 242 is coupled to the rearward-facing support legs 218 by pivotable joints 244 that permit the pivot support 242 to pivot, but which do not slide along the longitudinal length of the rearward-facing support legs 218.

The pivot support 242 may include two pivoting bars 246, each coupled to the rearward-facing support legs 218 at the joint 244, and also coupled to a latch mechanism 248 disposed between the rearward-facing support legs 218. When the walking device 210 is in the operative configuration, the two pivoting bars 246 are in a substantially linear arrangement, and secured in the linear arrangement by the latch mechanism 248. When transitioning the walking device 210 to the storage configuration, a user pulls on a release tab 250, which unlocks the latch mechanism 248. Continued pulling of the latch mechanism 248 in an upward direction allows the entire walker device 210 to collapse, as described herein.

Figure 17:
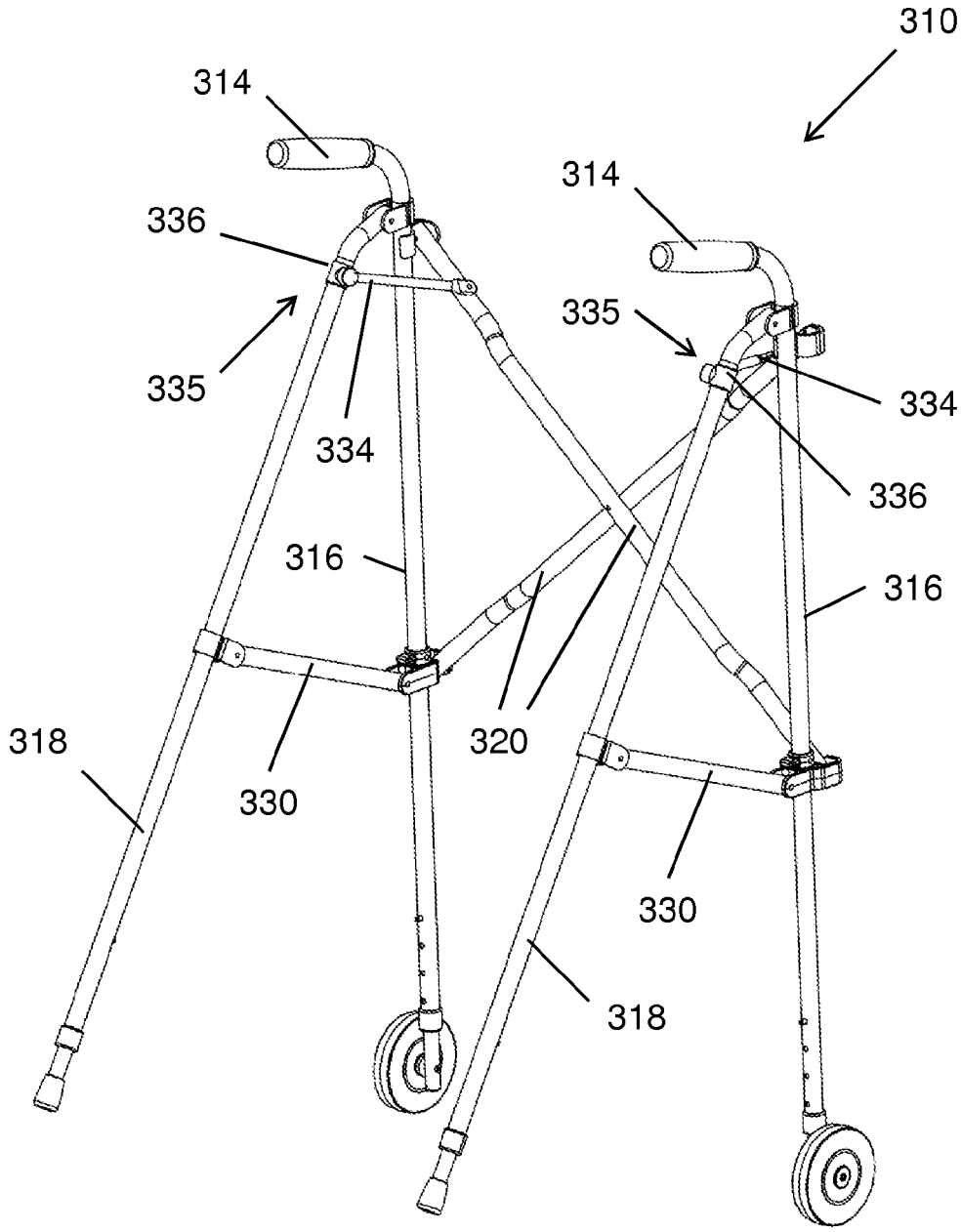
FIG. 17 is a perspective view of a collapsible walking device in an operative configuration, according to another embodiment.
Figure 18:
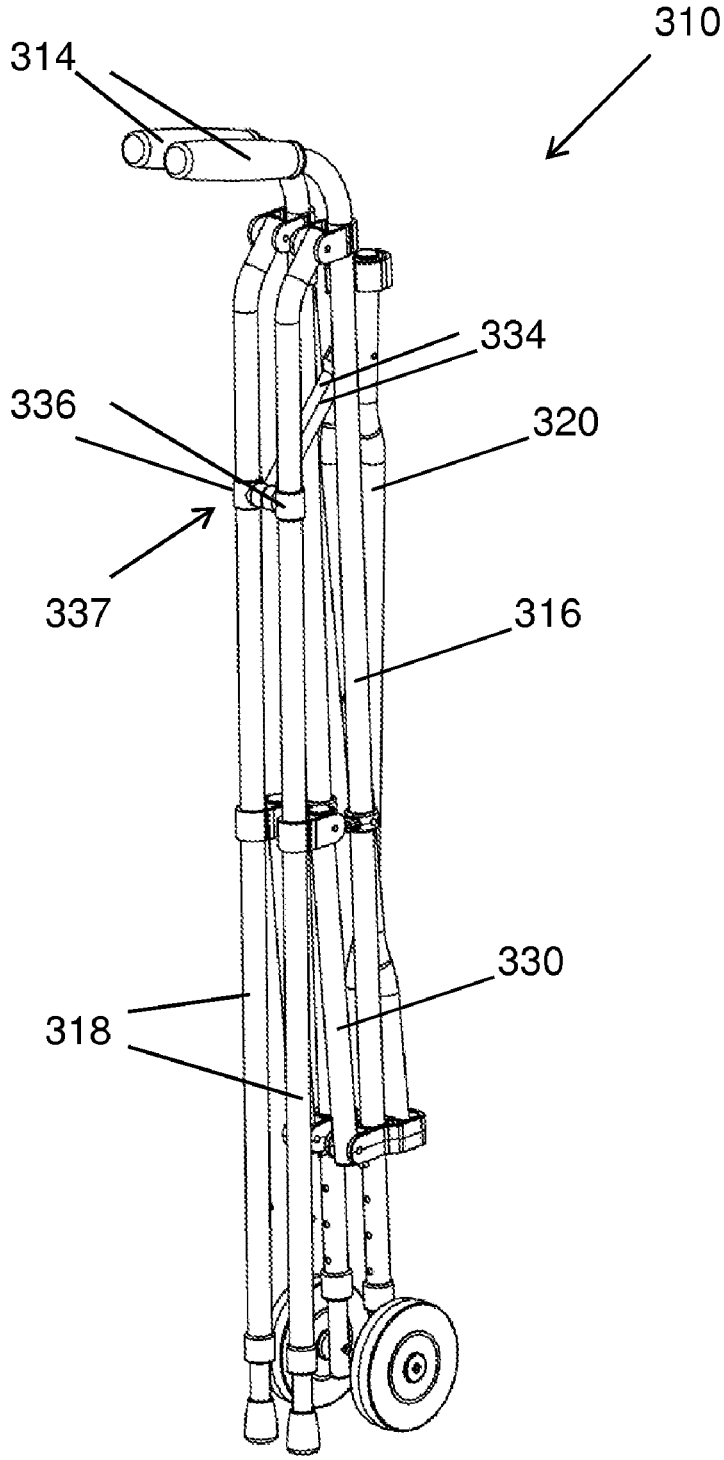
FIG. 18 is a perspective view of the collapsible walking device of FIG. 17 in a storage configuration.

FIGS. 17-18 illustrate another embodiment of a compressible walking device 310. FIG. 17 is a perspective view of the collapsible walking device 310 in an operative configuration and FIG. 18 is a perspective view of the collapsible walking device 310 in a storage configuration. The walking device 310 is similar to the walking device 110 of FIGS. 1-10 in structure and operation, having both an operable configuration and a storage configuration. The structure of the walking device 310 includes many similar components, including handles 314, handle legs 316, rearward-facing support legs 318, cross bars 320, stabilizer bars, and triangulation support bars 334. However, the locking joints are replaced by slidably moveable joints 336. As the walking device 310 is transitioned from the operable configuration to the storage configuration, the first and second handles, the first and second rearward-facing support legs and the first and second handle legs move toward each other and the rearward-facing support legs move toward the handle legs. The triangulation support bars 336 move from the substantially horizontal orientation (or more horizontal orientation) to a more vertical orientation as will be described.

The triangulation support bars 334 are coupled to rearward-facing support legs 318 of the walking device 310 by the slidably moveable joints 336. The slidably moveable joints 336 can slide along a portion of the longitudinal length of the rearward-facing support legs 318 as the walking device 310 is transitioned between the operative configuration and the storage configuration. The slidably moveable joints 336 may comprise a locking mechanism to secure the position of the joints 336 relative to the rearward-facing support legs 318. The locking mechanism may be activated by a simple button, lever, latch, etc., to allow quick and simple locking and unlocking of the joint relative to the rearward-facing support legs 318. The slidably moveable joints 336 may also facilitate pivoting in two directions of rotation. For example, the joints 336 may allow the triangulation support bars 334 to rotate about their longitudinal axis and also to pivot relative to the longitudinal axis of the rearward-facing support legs 318.

In the operative configuration, the slidably movable joints 336 coupling the triangulation support bars 334 to the rearward-facing support legs 318 are positioned at a first location 335 along the rearward-facing support legs 318, as shown in FIG. 17. In the storage configuration, the slidably movable joints 336 are positioned at a second location 337 along the rearward-facing support legs 318 at a position further spaced from the handle than the first location 335, as shown in FIG. 18. The slidably moveable joints 336 slide downward along the longitudinal length of the rearward-facing support legs 318, to the second location 337, when the walking device 310 is transitioned from the open configuration to the closed configuration. As the rearward-facing support legs 318 are moved toward the handle legs 316, the slidably moveable joints 336 may be forced downward along the rearward-facing support legs 318 to enable the triangulation support bars 334 to assume a more vertical orientation within the compact storage configuration.

Movement of the slidably moveable joints 336 upward along the rearward-facing support legs 318, in combination with movement of the rearward-facing support legs 318 toward each other and/or toward the handle legs 316, also causes the triangulation support bars 334 to pivot relative to the cross bars 320. The triangulation support bars 334 are coupled to cross bars 320 with joints 340 at a fixed position along the longitudinal length of the cross bars 320, such that the joints 340 do not move along the longitudinal length of the cross bars 320. The joints 340 may enable pivoting about one axis of rotation, as shown, allowing the triangulation support bars 334 to pivot relative to the cross bars 320. In another embodiment, the joints 340 may allow pivoting about a plurality of axes of rotation. The joints 336, 340 facilitate movement of the triangulation support bars 336 to transition to the vertical orientation of the storage configuration from the more horizontal orientation of the operative configuration.

While specific embodiments of collapsible walking devices have been illustrated and described, it is to be understood that the disclosure provided is not limited to the precise configuration and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way.

The invention claimed is:

1. A walking device to provide mobility support for a user and configured to be disposed in an operative configuration and a storage configuration, the walking device comprising:

first and second handles configured to be grasped by and support the user;

first and second handle legs that extend from the first and second handles, respectively, toward the ground and configured to be forward of the user in the operative configuration;

first and second rearward-facing support legs extending toward the ground and pivotably coupled to the first and second handle legs, respectively, the first and second rearward-facing support legs configured to also extend at an angle back toward the user in the operative configuration;

first and second cross bars, each cross bar pivotably coupled to the first and second handle legs, the first and second cross bars intersecting adjacent each other and pivotably coupled to each other; and a pivot support extending from the first rearward-facing support leg to the second rearward-facing support leg, the pivot support comprising first and second pivoting bars and a latch mechanism, the first pivoting bar coupled directly to the first rearward-facing support leg and to the latch mechanism and the second pivoting bar coupled directly to the second rearward-facing support leg and to the latch mechanism, the latch mechanism configured to secure the first and second pivoting bars in a substantially linear arrangement in the operative configuration;

wherein the handle legs, rearward-facing support legs, cross bars, pivot support and respective interconnecting joints are configured to permit the walking device to move from the operative configuration to the storage configuration in a single motion by pulling upward on the latch mechanism toward the handles, which simultaneously brings the first and second handles, the first and second handle legs, and the first and second rearward-facing support legs toward each other and the rearward-facing support legs toward the handle legs.

2. A walking device of claim 1, the latch mechanism further configured to allow the first and second pivoting bars to pivot toward each other to a substantially parallel arrangement in the storage configuration.

3. A walking device of claim 1, the latch mechanism further comprising a release tab to unlock the latch mechanism from securing the first and second pivoting bars in the substantially linear arrangement of the operative configuration.

4. A walking device of claim 1, further comprising first and second stabilizing bars, the first stabilizing bar pivotably coupled to the first handle leg and the first rearward-facing support leg and the second stabilizing bar pivotably coupled to the second handle leg and the second rearward-facing support leg.

5. A walking device of claim 1, further comprising a first slidably moveable joint to couple the second cross bar to the first handle leg at a location along the first handle leg spaced apart from the handle and a second slidably moveable joint to couple the first cross bar to the second handle leg, wherein each slidably moveable joint is configured to slidably move along the length of the respective handle leg as the walking device is transitioned between the operative configuration and the storage configuration.

6. A walking device of claim 5, wherein the first slidably moveable joint also couples a first stabilizing bar to the first handle leg and the second slidably moveable joint also couples a second stabilizing bar to the second handle leg.

7. A walking device of claim 1, wherein the first and second rearward-facing support legs comprise a bend configured to enable the first and second stabilizing bars respectively to be disposed parallel to and between the first and second rearward facing support legs and the first and second handle legs respectively, when the walking device is in the storage configuration.

8. A walking device of claim 1, further comprising first and second wheeled tips disposed at an end of the first and second handle legs, respectively, opposite the first and second handles and proximate to the ground.

9. A walking device of claim 1, further comprising first and second telescoping height adjustment mechanisms to enable adjustment of the length of the first and second handle legs respectively, and thereby adjust the height of the first and second handles from the ground.

10. A walking device of claim 9, wherein the first and second telescoping height adjustment mechanisms comprise:

a telescoping tube configured to be slidably moveable relative to the respective handle leg;

a button pivoting component comprising a pin disposed at a first end of the button pivoting component and a button portion disposed at a second end of the button pivoting component such that the pin and button portion can rotate about a pivot point positioned between the pin and the button portion, wherein the pin is configured to engage a hole in the telescoping tube and a hole in the handle leg to secure the position of the telescoping tube relative to the respective handle leg, wherein the button pivoting component is biased to pivot toward engagement by the pin of the holes to secure the telescoping tube relative to the handle leg, and wherein depressing the button disengages the pin from the holes to allow the telescoping tube to slidably move relative to the respective handle leg; and a stationary pivot component secured to the respective handle leg and providing a pivot point about which the button pivoting component pivots.

11. A walking device of claim 10, wherein the telescoping tube is configured to be received within the handle leg and comprises a plurality of aligned holes spaced along a portion of a length of the telescoping tube, wherein the height of the handle leg can be adjusted by disengaging the pin from a first hole of the plurality of holes in the telescoping tube, sliding the telescoping tube relative to the handle leg, and engaging the pin in a second hole of the plurality of holes in the telescoping tube.

12. A walking device of claim 10, wherein the telescoping tube is configured to receive the handle leg, and wherein the handle leg comprises a plurality of aligned holes spaced along a portion of a length of the handle leg, wherein the height of the handle leg can be adjusted by disengaging the pin from a first hole of the plurality of holes in the handle leg, sliding the telescoping tube relative to the handle leg, and engaging the pin in a second hole of the plurality of holes in the handle leg.

* * * * *